US005090691A

United States Patent [19]

Pollock

[11] Patent Number: 5,090,691

[45] Date of Patent: Feb. 25, 1992

[54] ACTIVE AND PASSIVE HANDLE FOR EXERCISE DEVICE

[76] Inventor: Todd E. Pollock, 3216 West 21st Ave., Spokane, Wash. 99204

[21] Appl. No.: 563,518

[22] Filed: Aug. 6, 1990

[51] Int. Cl.[5] ..... A63B 21/00

[52] U.S. Cl. ..... 272/93; 248/693; 24/129 D; 441/69; 294/153; 16/114 B; 272/143

[58] Field of Search ..... 272/93, 116, 118, 126, 272/143, 67, 68, 75; 441/69, 84; 24/129 D, 137 C; 294/25, 153, 156; 248/693; 16/114 B, 119, 125

[56] References Cited

U.S. PATENT DOCUMENTS

| | | | |
|---|---|---|---|
| 200,665 | 12/1877 | Ottinger | 24/129 D |
| 292,148 | 1/1884 | Travis et al. | 24/129 D |
| 4,019,734 | 4/1977 | Lee et al. | 272/143 |
| 4,040,620 | 8/1977 | Friedman | 272/143 |
| 4,109,905 | 8/1978 | Meier | 272/143 |
| 4,661,077 | 4/1987 | Griffith et al. | 441/84 |
| 4,978,119 | 12/1990 | Hull | 272/118 X |

OTHER PUBLICATIONS

Websters New World Dictionary—Third College Edition; Copyright 1988; p. 611.

*Primary Examiner*—Richard J. Apley
*Assistant Examiner*—Thomas L.
*Attorney, Agent, or Firm*—Keith S. Bergman

[57] ABSTRACT

A handle for exercise devices provides a flexible cord having a loop formed in one end for slidable extension through a medial channel defined in a handle. The handle provides a diametrically larger knob-like structure proximate the inner end of the loop with a diametrically smaller elongate body extending a spaced distance away therefrom. The loop extending from the handle has a tubular cover about its medial portion to protect a user and provide frictional engagement with a wrist. The handle allows varying degrees of user gripping from a completely passive to a completely active type as determined by a user.

4 Claims, 1 Drawing Sheet

FIG. 1
Prior Art
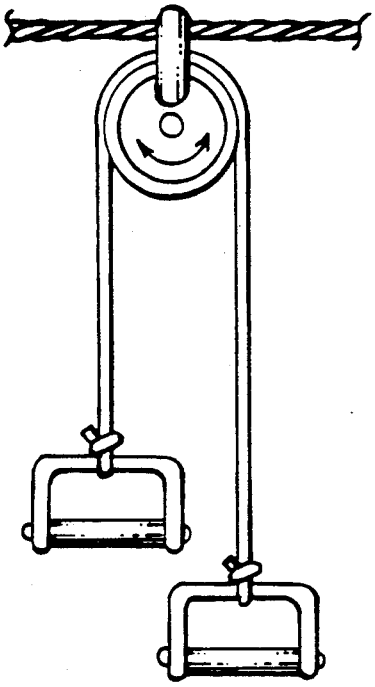
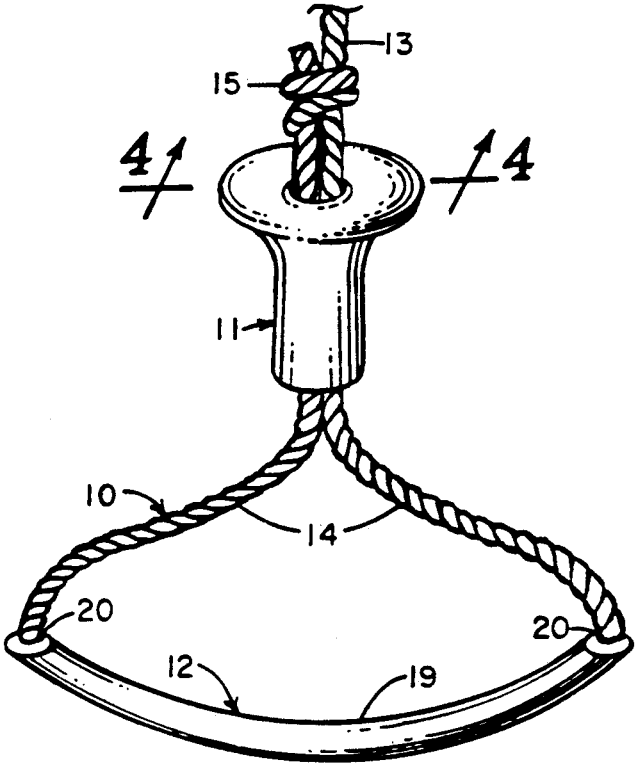
FIG. 2
FIG. 3A
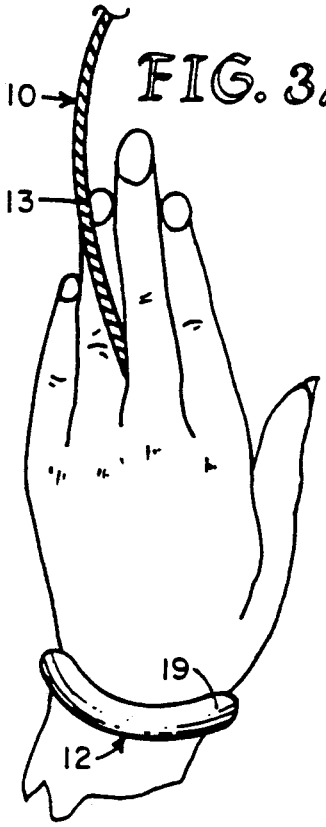
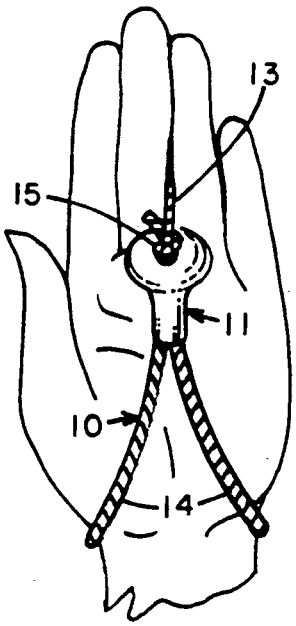
FIG. 3B
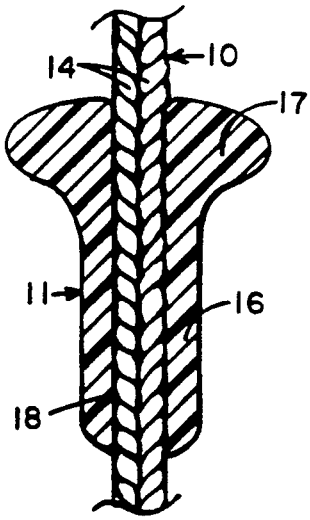
FIG. 4

ACTIVE AND PASSIVE HANDLE FOR EXERCISE DEVICE

BACKGROUND OF INVENTION

A. Related Applications

There are no applications related hereto heretofore filed by the instant inventor in this or any foreign country.

B. Field of Invention

My invention relates generally to passive handles for exercise devices, and more particularly to a loop type handle formed in a flexible cord with an elongate handle slidably carried thereon to allow user determination of the degree of passivity of use.

C. Background and Description of Prior Art

Exercise of the upper portion of the human body is generally accomplished by some type of activity of the arms, and this activity when conducted in conjunction with exercise devices generally involves the gripping of some sort of a handle structure by the hands. Exercise devices for this purpose, both for the amateur and for professional therapeutic use, are many and varied, but most share in common some sort of a handle structure to maintain the user's hand relative to the exercise device. The instant invention provides a new and novel handle to allow varying degrees of passive use of such exercise devices.

Handles for upper body exercise devices generally have provided some sort of a rigid, cylindrical structure that extends laterally across the palm or inner finger portion of a user's hand so that the outer finger portion of the hand may be closed about the handle to grasp and positionally maintain it. Most of such handle structures take the form of an elongate rod-like element extending between the spacedly opposed legs of a stirrup-type yoke. Such handles are often configured in somewhat of a barrel-like shape with a prolately enlarged medial portion to better, more comfortably and conformably fit a user's hand and aid grasping. The use of such type of handle structures has become so universal that users are habitually familiar with the structure and have developed muscular and neural responses for the grasping of such handles that aid that grasping, both by reason of muscular development and familiarity.

Often when using exercise devices with such handle structure, especially in the case of rehabilitative physical therapy, the potential user may not have adequate muscle strength or neural control to effectively grasp and operatively maintain such a handle structure, yet exercise with such a device may not only be desirable but also necessary to aid in developing appropriate neural control and muscular strength. This creates a rather self-defeating type problem which has heretofore been recognized and responsively, various solutions have heretofore been proposed. My invention provides a novel solution to the problem in the form of a new and different handle structure.

When a user cannot actively maintain appropriate manual interconnection with an exercise device, the most common method of providing such interconnections has been to use some type of a passive interconnecting device or mechanism. Most such passive connectors have provided an elongate, flexible strap or band that has been wrapped in some fashion, generally in multiple courses, about the fingers and the associated handle structure to interconnect a hand and a handle in a manner sufficient to allow the contemplated exercise functions. In some such interconnections a strap has been attached, generally in a single course, about some portion of the wrist or arm structure rather than being wound directly about the clenched fingers. Such straps also in some instances have provided a hook or other similar rigid fastening means to engage a handle to carry substantially the entire load or force generated thereby. Any such passive fastening devices, however, tend to disrupt the normal muscular and neural activity required for ordinary handle grasping and therefore do not completely fulfill the desired exercise result. Such devices also generally require either completely active or completely passive grasping and do not allow variations that partially involve both activities, so that it is not possible to accomplish varying degrees of active handle grasping with them.

My invention, in contradistinction to such prior devices, provides an elongate flexible cord element knotted at its end part to form a loop which extends through an elongate slidable handle having an enlarged knot-facing portion with a smaller body portion extending therefrom. The handle is used with the loop extending about the back of the user's wrist and with the handle portion on the palm, oriented with the enlarged portion facing the fingertips and the interconnecting cord extending between two of a user's fingers. With this arrangement, the loop may be completely passively used to interconnect a user's hand by tightening it appropriately by moving the handle. A user may also tighten his fingers about the handle member in a grasping fashion to allow varying degrees of active involvement of the hand and fingers as determined by the user. This handle structure then provides a handle that extends more in an elongate fashion on a palm side of a user's hand, as opposed to the generally lateral fashion of the ordinary handle, and allows varying amount of active participation in grasping, from a completely passive type grip to a completely active one as determined by a user.

My invention resides not in any one of these features individually, but rather in the synergistic combination of all of the structures of my handle that necessarily give rise to the functions flowing therefrom, as herein specified and claimed.

SUMMARY OF INVENTION

My invention generally provides a structure having an elongate flexible cord knotted at a first end to form a loop with its second end interconnected to an exercise device. The loop carries an elongate padding tube about its medial portion, and slidably carries a handle structure about its inner portion adjacent the loop forming knot. The handle structure provides an elongate cylinder with a diametrically larger knot-facing knob portion and a diametrically smaller body portion both defining a medial loop channel, therethrough to allow slidable support on the loop between the knot and the padding tube.

In providing such a handle structure, it is:

A principal object of my invention to create a handle for exercise devices that may be used in varying modes from a completely passive to complete actively held mode.

It is a further object of my invention to provide such a handle with which a user may select by his neural and muscular control the degree of passivity and activity with which the handle is to be used.

A further object of my invention is to provide such a handle structure that in use may maintain the traditional and habitually familiar muscular and neural reactions that are incurred in grasping rigid rod-like handle structure such as traditionally extend laterally across the palm of the hand of a user and are positionally maintained by grasping the fingers thereabout.

A still further object of my invention is to provide such a device that is of new and novel design, of rugged and durable nature, of simple and economic manufacture and one otherwise well suited to the uses and purposes for which it is intended.

Other and further objects of my invention will appear from the following specification and accompanying drawings which form a part hereof. In carrying out the objects of my invention, however, it is to be understood that its features are susceptible of change in design and structural arrangement, with only one preferred and practical embodiment being described as is required.

BRIEF DESCRIPTION OF DRAWINGS

In the accompanying drawings which form a part hereof and wherein like numbers of reference refer to similar parts throughout:

FIG. 1 is an orthographic view of a prior art stirrup-type handle commonly used in various hand manipulated exercise devices.

FIG. 2 is an isometric view of my passive handle structure showing its various parts, their configuration and relationship.

FIGS. 3A and 3B are isometric views of the back side and the front side of a hand, respectively, showing the method of positioning my device for use.

FIG. 4 is an elongate cross sectional view through the handle structure of FIG. 2, taken on the line 4—4 thereon in the direction indicated by the arrows.

DESCRIPTION OF THE PREFERRED EMBODIMENT

My invention generally provides elongate flexible cord 10 having a first end interconnectable to an exercising machine and a second end defining a loop slidably carrying elongate handle 11 in its inner part and tubular gripping member 12 about its outer part.

Flexible cord 10 defines a configuration having elongate body portion 13 with loop 14 formed by looping one end part upon the body and fastening it to the body portion by knot 15. Body portion 13 is of appropriate length to interconnect with an exercise device and position loop portion 14 where it is desired that the device be gripped by the hand of a user. Loop portion 14 is approximately twelve inches in circumference, though this dimension is neither essential nor critical so long as the loop dimension is somewhat greater than the circumference of a wrist to be supported. Knot 15 is of a type that provides a non-slipping interconnection of the cord end with the cord body, such as the knot commonly known as a bowline. The knot, in and of itself, is not critical to my invention and other types of non-slipping interconnection of the cord portions may serve the same function, such as a ferrule, wire connector, splicing or the like, as the primary purpose of the knot is to form a fixed loop structure.

Cord 10 is formed from some resiliently flexible material, commonly of a fibrous nature, and by a process that provides sufficient confirmational integrity to reasonably well maintain the cord shape during usage. The cord has a generally circular cross-section and may be formed by weaving, braiding or twisting for maintenance of configurational integrity. The cord must have sufficient strength to fulfill its purpose of operating an exercise device, but yet should not have too large a diameter so as to be too cumbersome or bulky. The ideal diametric size range approximates 0.25 inch or thereabouts, and cords of this size provide appropriate strength when formed from various woven or twisted polymeric fibers, especially nylon, polyethylene or similar polymeres. Such materials have the added advantage of providing a relatively smooth, harder cord surface which tends to aid slipping motion of handle 11 on cord loop 10 and also provides a durable structure. Undoubtedly, however, most fibrous cord materials of flexible nature, reasonable size and appropriate strength will fulfill the purposes of my invention, if possibly not so well.

Elongate handle 11 provides diametrically smaller body portion 16 and diametrically larger head portion 17. In the instance illustrated, the handle is defined by a surface of revolution, though this shape is not essential to my handle structure and it may take other cross-sectional shapes, especially various asymmetrical shapes of a somewhat oblate cross-section. The head portion 17 has a diameter generally two to three times greater than the diameter of body portion 16, and preferably, though not necessarily, these handle elements will be formed with relatively smooth curvilinear transition zones between surfaces at their intersections and about edges for ease and convenience of use, prevention of injuries that might be caused by the handle, and improved aethestics. The length of the handle, that is the dimension along its axis, is such as to allow convenient holding in the hand of a user. This usually requires an overall length of approximately three inches, with a major body diameter of approximately 0.75 inch and a head diameter of approximately 1.5 inches. These dimensions are illustrative only and may vary in individual cases and yet remain within the spirit and scope of my invention so long as the handle purposes are fulfilled.

The medial portion of the handle defines cord channel 18 extending axially therethrough to allow slidable carriage on the looped portion 14 of the flexible cord. Channel 18 is so sized and configured as to allow the insertion therethrough and slidable passage of the opposed strands of loop 14. The cord strands are preferably maintained in channel 18 with some frictional engagement to positionally maintain the handle on the loop when in unstressed condition, but yet allow sliding motion of the handle upon the loop strands with relatively small manipulative force. The channel in the instance illustrated is of somewhat elongate shape to accomplish this purpose, though the shape is not critical and may vary so long as it fulfills the purposes stated. The overall cross-sectional size of the cord channel should be such as to prevent knot 15, or any corresponding fastening structure, from passing therethrough to maintain the handle structure on the loop portion 14 of the cord and prevent its passage inwardly onto body portion 13 of the cord. This structure is a matter of convenience rather than necessity, however, and the handle may be operative, though not so conveniently so, even though the knot or its equivalent does not prevent handle passage thereover.

The handle is formed of some rigid, reasonably durable material such as wood or polymeric or resinous plastic. If desired, the entire exterior surface of the handle or selected portions may be provided with grip aiding devices (not shown) such as knurling or soft frictional materials to aid gripping during use. By reason of the overall configuration of the handle, however, such gripping generally aids are not necessary and gripping may be readily accomplished for most use without aids.

Tubular gripping member 12 provides elongate tube 19 of a length sufficient to cover about one third of the length of loop 14. The gripping member in the form illustrated has an annular cross-section with a major external diameter of approximately three times that of cord 10 and an internal channel diameter substantially the same as that of the external diameter of cord 10 so that the cord may extend through the channel, but yet the gripping member will be positionally maintained on the cord with some frictional resistance to sliding motion. The gripping member is formed of a relatively soft, resiliently deformable material, preferably with a surface of reasonably high frictional characteristics such as rubber or various elastomeric or softer polymeric plastics that provide reasonable strength and durability. The cross-sectional shape of tubular member 19 that is illustrated is not essential to my invention and other cross-sectional shapes, especially those of a somewhat flattened or oblate nature will serve its purposes and in some instances may be more desirable than the circular cross sectional shape.

Having thusly described the structure of my handle, its use may be understood.

My handle is for use in conjunction with various exercise devices that require a pulling or tensive force in their operation and are manipulated by the hands of a user. These devices in the past commonly have used some type of a rigid rod-like handle for grasping by force of a user's fingers wrapped thereabout. Such handles may interconnect with the associated exercise device in various fashions, but most commonly they are interconnected by a flexible linkage of cord-like nature. My invention replaces such actively operated handle structures.

For use, a handle structure is created according to the foregoing specification. Commonly such structures will be used in pairs, though they may be used singly or n groups greater than two. In the case of an exercise device already having a cord-like operative element, the cord of my handle is interconnected in that operative system, with the length of cord 10 being appropriately adjusted to position the handle 11 at an appropriate position relative to the exercising device for use in its ordinary and traditional fashion.

If an exercise device with which my invention is to be used provides some other type of handle structure that is interconnected in a fashion other than by a flexible cord-like element, the flexible cord of my device is interconnected to that handle or associated structure by known methods and the length of cord 10 is adjusted to position handle 11 in appropriate relationship to the exercise device to allow normal use in a traditional fashion by a user. The interconnection of cord 10 to the exercise device may be accomplished directly by wrapping and knotting the cord about the existing structures of that device or by use of various known mechanical connectors. Once my handle structure is established on an exercise device by the interconnection described, it is ready for use as illustrated particularly in FIGS. 3A and 3B.

For use, handle 11 is moved immediately adjacent knot 15 to enlarge loop 14 to its maximum size. Gripping member 12 is moved to a medial position in the loop, if it not be in such a position. The movement of these elements relative to each other is readily accomplished by appropriate manual manipulation by sliding either the handle or gripping member on the cord carrying it. In this condition, the handle structure is placed upon the hand of a user.

The expanded loop 14 is placed about the back of a user's wrist with the gripping member 12 extending laterally across the back of the hand in approximately its medial portion and with the handle structure on the palm side of the handle as illustrated in FIG. 3A. Body portion 13 of the cord is then moved into the space between two of a user's fingers, commonly the second and third fingers, so that the cord body extends away from the hand on its back side. With the cord structure in this position, handle 11 is moved on loop 14, away from the fingers and toward the heel of the hand, to tighten the loop in a reasonably good fit about the back portion of the wrist, as illustrated particularly in FIG. 3B. In this position, the device is ready for use as a passive handle.

In passive use of the handle, it is to be noted that cord 10 will exert a tensive force relative to an exercise device. As this occurs, since cord body 13 is carried at a point on the hand more distal from the palm and on the same side as the loop portion, tensive forces in cord 10 will tend to tighten loop 14 about the back of a user's wrist because of the angular relationship between the cord body and the loop. As this occurs and as more force is applied to the cord body, the loop will be tightened to provide positional maintenance about the wrist corresponding to the amount of tensive force that is exerted by cord body 13, to automatically adjust the holding capacity of loop 14 to the capacity required. In this condition, the loop may be completely passively retained on the hand, and tensive type exercise operations may be carried out in such a fashion as desired.

Handle 11 also allows the device to be used with varying degrees of activity as may be desired by a user. To establish active use of the handle, the fingers are moved inwardly over the palm of the hand and about handle 11 until the handle is grasped by the inner surface of the fingers, between them and the adjacent portion of the palm. In this condition, the grip of the fingers may be tightened about the handle structure by voluntary control of the muscles of the hand. As this grasping increases, the holding of the handle of my exercise device produces substantially the same muscular reactions as are produced in active grasping of a typical cylindrical type handle extending transversely in the hand. The degree of active holding of the handle may be increased from a null amount to substantially the same degree of active force as would be required to hold s rod-type handle with the same resistive force restraining its motion. My handle structure then allows use of an exercise device with completely passive hand activity through selectively determinable degrees of active grasping to an upper limit whereat the handle structure is completely actively grasped.

It should be noted that my handle structure may be used with most hand manipulated exercise devices that make use of a tensive or pulling force, and in general the handle may be attached for use on such exercise devices without any, or at least only minor, structural modifications or changes in the exercise device. The handle structure, though designed primarily for manipulation by the hands of a user, may also be used in association with the feet or fastened about various portions of the limbs of a user. Though those uses are not the primary purpose of the device, they are yet within the ambit and scope of my invention, even though such use would be entirely passive.

It should be further noted that, though not illustrated, the knotted end of the cord may be attached to the handle instead of being knotted about the body of the cord and still accomplish its same purpose. The loop also may be formed of compound interconnected elements rather than from a continuous length of cord. These variations remain within the ambit of my invention.

It should be further noted that though my handle structure is intended primarily for use with exercise devices, it well might serve the additional purpose of fastening some object or item to the hand of a user for passive interconnection when that hand might not be capable of actively grasping the device for active interconnection, such as for carriage or other similar use.

The foregoing description of my invention is necessarily of a detailed nature so that a specific embodiment of it might be set forth as required, but various modifications of detail, rearrangement and multiplication of parts might be resorted to without departing from its spirit, essence or scope.

Having thusly described my invention, what I desire to protect by Letters Patent and what I claim is:

1. A handle structure for passive and active interconnection of the limbs of a human to a tensive type exercise device, comprising, in combination:

an elongate, flexible tensive element having a first end for interconnection with an exercise device, said flexible tensive element having a body and a loop formed at its second end by overlapping the second end upon itself and fastening the second end to the flexible element body to prevent the passage of a handle thereover;

an elongate handle defining an internal channel therethrough and having a diametrically smaller and axially longer body portion and a diametrically larger and axially shorter head portion of oblately spheroidal configuration, said handle slidably carried on the loop defined by the flexible tensive element with the head portion of the handle proximal the elongate flexible tensive element body and the loop of said element extending outwardly therefrom; and an elongate gripping member defining an internal channel, said gripping member carried about the medial portion of the elongate flexible tensive element forming the loop, outwardly of the handle member.

2. The handle of claim 1 wherein the fastening means fastening the second end of the flexible tensive element on the body of that element comprise knotting that second end to the body with a knot that is fixedly positioned relative to the body.

3. The invention of claim 1 wherein the gripping element further comprises an elongate tube formed of a soft, resiliently deformable material defining a channel that carries the loop portion of the elongate flexible tensive element with frictional engagement to aid positional maintenance.

4. A handle structure for passive and active interconnection of the limbs of a human to a tensive type exercise device, comprising, in combination:

an elongate flexible cord having a body portion with a first end for interconnection to a tensive type exercise device and a loop formed in the second end portion by knotting the second cord end upon the cord body in an immovable fashion;

an elongate handle having a diametrically smaller and axially longer body portion and a diametrically larger and axially shorter head portion of oblately spheroidal shape, said handle defining a medial channel extending in an elongate direction therethrough, and being slidably carried upon both cords of the loop adjacent the knot forming the cord loop, with the head portion of the handle proximal the knot; and a gripping member comprising an elongate tube defining a channel extending in an elongate direction therethrough, said gripping member being slidably and frictionally engaged upon the medial portion of the cord forming the loop outwardly of the handle carried thereon, and being formed of flexible resiliently deformable material to aid frictional engagement with and positional maintenance upon the hand of a user and upon a cord.

* * * * *